US008800797B2

(12) United States Patent
Fingerhut et al.

(10) Patent No.: US 8,800,797 B2
(45) Date of Patent: Aug. 12, 2014

(54) HEAT AND EXPLOSION RESISTANT CARGO CONTAINER

(76) Inventors: Richard L. Fingerhut, Tarzana, CA (US); Robert C. Fu, San Pedro, CA (US)

( * ) Notice: Subject to any disclaimer, the term of this patent is extended or adjusted under 35 U.S.C. 154(b) by 70 days.

(21) Appl. No.: 13/542,481

(22) Filed: Jul. 5, 2012

(65) Prior Publication Data

US 2014/0008358 A1 Jan. 9, 2014

(51) Int. Cl.
*B65D 88/22* (2006.01)

(52) U.S. Cl.
USPC ..... 220/88.1; 220/1.5; 220/9.4; 220/4.33

(58) Field of Classification Search
USPC ..... 220/1.5, 4.28, 668, 4.33, 9.4, 9.1, 900, 220/88.1, 693, 692; 109/79; 206/577
See application file for complete search history.

(56) References Cited

U.S. PATENT DOCUMENTS

| | | | | |
|---|---|---|---|---|
| 3,567,536 | A | 3/1971 | Wickersham, Jr. | |
| 3,739,731 | A | 6/1973 | Tabor | |
| 4,212,406 | A | 7/1980 | Mittelmann | |
| 4,538,663 | A * | 9/1985 | Looker | 160/368.1 |
| 4,833,771 | A | 5/1989 | Dunwoodie | |
| 5,102,723 | A | 4/1992 | Pepin | |
| 5,180,078 | A | 1/1993 | Looker | |
| 5,195,701 | A | 3/1993 | Willan | |
| 5,242,070 | A | 9/1993 | Bretschneider et al. | |
| 5,249,534 | A | 10/1993 | Sacks | |
| 5,267,665 | A | 12/1993 | Sanai et al. | |
| 5,312,182 | A | 5/1994 | Mlakar et al. | |
| 5,328,268 | A | 7/1994 | LaFleur | |
| 5,360,129 | A | 11/1994 | Lee | |
| 5,390,580 | A | 2/1995 | Gibbons et al. | |
| 5,395,682 | A | 3/1995 | Holland et al. | |
| 5,398,831 | A | 3/1995 | Avramides et al. | |
| RE34,892 | E | 4/1995 | Dunwoodie | |
| 5,413,410 | A | 5/1995 | Mlakar | |
| 5,421,804 | A | 6/1995 | LaFleur | |
| 5,425,456 | A | 6/1995 | Erickson | |
| 5,522,340 | A | 6/1996 | Skogman | |
| 5,542,765 | A | 8/1996 | Smith et al. | |
| 5,595,305 | A | 1/1997 | Hart | |
| 5,595,431 | A | 1/1997 | Mlakar | |
| 5,599,082 | A | 2/1997 | Mlakar et al. | |
| 5,645,184 | A | 7/1997 | Rowse et al. | |
| 5,769,257 | A | 6/1998 | Fleisher et al. | |
| 5,890,612 | A | 4/1999 | Coppi | |
| 5,967,357 | A | 10/1999 | Kellogg et al. | |
| 6,019,237 | A | 2/2000 | Durham et al. | |
| 6,161,714 | A | 12/2000 | Matsuura et al. | |
| 6,237,793 | B1 | 5/2001 | Fingerhut et al. | |
| 6,749,076 | B2 | 6/2004 | Fingerhut et al. | |

* cited by examiner

*Primary Examiner* — Stephen Castellano
(74) *Attorney, Agent, or Firm* — Fulwider Patton LLP

(57) ABSTRACT

Provided herein is a blast resistant cargo container sufficiently lightweight to be practical for aircraft transport. The container includes a frame assembly and a plurality of panels. Innovative panel connections between side panels and a unique door latching system improve the weakest links of the container. The plurality of panels includes a top panel, a bottom panel, a plurality of side panels and a flexible door. The side panels and the flexible door are formed of at least one explosion resistant sheet of a flexible, high tensile strength material. Edges of the sheets are wrapped around and secured to a rod. An edge capturing rail is wrapped around the sheets over each rod. The latching mechanism involves retaining a locking rail extending from the door panel in a groove of a doorpost or door sill with a detent bar.

15 Claims, 15 Drawing Sheets

HEAT AND EXPLOSION RESISTANT CARGO CONTAINER

STATEMENT REGARDING FEDERALLY SPONSORED RESEARCH OR DEVELOPMENT

The invention was made with Government support under Contract No. HSHQDC-09-C-00052 awarded by the Transportation Security Laboratories of the Department of Homeland Security. The Government has certain rights in the invention.

BACKGROUND

1. Field of the Invention

This invention relates generally to cargo containers capable of withstanding and containing explosions therein. More specifically, the invention is directed at such containers that are also sufficiently lightweight such that it is not cost prohibitive to use them on aircraft.

2. Description of Related Art

In the airline industry, containment devices are commonly referred to as Unit Load Devices (ULDs). Explosion resistant containment devices are known as Hardened Unit Load Devices (HULDs). The specifications (weight, size, shape) for either type of ULD have been partially standardized by regulatory requirements and on account of practical concerns. The odd shape of the containers, with its sloped surfaces is designed so that the ULD fits into the aircraft's fuselage specifically.

Current ULD's are typically constructed of lightweight aluminum or other thin metal or composite materials that provide no protection against an explosive blast and becomes shrapnel during even a small explosion.

A problematic drawback of conventional HULDs or explosion resistant containment devices has been that they are generally heavier than conventional ULDs and cargo containers with thicker walls. While benefits provided by HULDs, including enhanced safety and preventing damage to other cargo, are highly desirable the increase in weight can be cost prohibitive in an already struggling industry.

With airlines already struggling to stay in business and the average traveler for pleasure unwilling to spend more than a certain amount to fly, this increase in weight for safer blast resistant containers can be cost prohibitive. It is unfortunate that the cost of this important safety measure should come at a price so high that it is not implemented. There is a need for a lighter weight, less expensive explosion resistant containment device than those presently available.

When an explosion occurs there is initially a high magnitude shock wave for a short duration followed by lower magnitude, more uniform waves that last much longer. A blast-resistant container must be able to survive both stages and both types of waves. Even the second stage of lower magnitude waves are generally several times atmospheric pressure which is more than the conventional ULD can withstand.

Known techniques for modifying cargo containers to deal with explosions in the fuselage include the venting method, the rigid confining method, and frameless designs. The venting method involves allowing an explosive to penetrate a wall of the fuselage to vent shock waves and high pressures outside the plane. Obviously, controlling the destruction is less ideal than preventing it altogether and is costly due to the damage suffered by the plane. The rigid confining method involves thick, energy-absorbing panels mounted on a rigid frame. The thick panels are focused on absorbing high energy produced during the explosion but the more relevant factor is high stress. Thick panels and a rigid frame can exacerbate concentration of stress at the edges and may be unable to appropriately reduce or redistribute bending stresses. In frameless designs the container is designed to flex, bend, and otherwise deform during a blast. One problem that remains is how to connect the panels to provide structural integrity and how to incorporate a latching mechanism doesn't disproportionately weight down the container.

There is a need for a heat and explosion resistant cargo/baggage container having a panel connection design and latching mechanism that does not undermine the blast resistant nature of the container's panels. The unique door latching/locking mechanism as shown and described herein is easier and faster to operate as compared to the designs incorporated in older Hardened Unit Load Devices (HULDs). One of these older latching/locking mechanism designs consisted of a pair of opposing hook-shape rails and required other tensioning devices (e.g. straps) to make it secure.

Further, there exists a need for a blast resistant cargo/baggage container for aircraft that weighs approximately the same as or less than a conventional, non-hardened, non-blast resistant container. It would be desirable for the walls of the container to be formed of lighter weight materials capable of protecting against an explosive without rupturing and without concentrating too much stress at the edges and near the latch. The present invention meets these needs.

SUMMARY OF THE INVENTION

The present invention seeks to provide cost-effective explosion resistant containers so that caution need not be thrown to the wind and aircraft passengers can experience enhanced safety and security of their cargo without any significant increase in fare.

Provided herein is a container having a semi-rigid body structure and explosion resistant enclosure including blast resistant side, floor, roof and door panels. The unit is capable of expanding in a controlled fashion and containing the shock, gas pressure, fragment and post-event combustion resulting from the detonation of an explosive (or improvised explosive device) placed within it.

Briefly and in general terms, the present invention provides an explosion resistant cargo container suitable for aircraft or seagoing vessels for containing the effects of a bomb explosion within the cargo container. The container includes a frame assembly and a plurality of panels mounted to the frame assembly. The plurality of panels include a top explosion resistant panel, a bottom explosion resistant panel, a plurality of explosion resistant side panels, and an explosion resistant flexible door having two side edges and a bottom edge. The side panels and flexible door are both formed of a plurality of explosion resistant sheets, each sheet of said plurality being formed of an explosion resistant, flexible, high tensile strength material. The plurality of explosion resistant sheets are wrapped around and secured to a rod at their edges.

Additionally, there are a plurality of edge capturing rails, each edge capturing rail wrapped around each plurality of explosion resistant sheets over each edge rod, securing adjacent edges of the panels together along with a plurality of fasteners, each fastener extending through two or more panels and an edge capturing rail.

The bottom explosion resistant panel serving as the floor or base of the container may be made of a combination of explosion resistant sheets and metal sheet, metal preferably being on the exterior side to withstand routine handling and flight missions. The frame structure of the blast resistant container may be similar to that of a conventional, non-hardened cargo container. For example, frame members are joined together by gussets or brackets. The rigid frame structure is designed to carry the intended cargo load in flight and to maintain stability of the container during ground handling.

The blast resistant side, roof and floor panels are joined together via innovative edge connections, which match the maximum strength of the panel material. Accordingly, the edge connections do not stand out as the weakest link vulnerable to giving out in the event of an explosion. Rather the strength of the container is consistent throughout which enhances its durability.

The container described herein, constructed in accordance with the principles of the invention, improves upon currently available explosion resistant containers to provide superior performance through a reaction mechanism that includes stretching, flexing, and slight movement of the door along the doorposts and door sill. For example, the design for the latching mechanism includes a detent bar mounted to the frame assembly with guide pins through oversized holes such that the detent bar can extend and retract via movement of the guide pin within the hole. These features assist to dissipate explosive forces in a manner that does not substantially weaken panel materials over time or permit a pressure buildup. In any event, if a panel were to be damaged the container is designed with the desirable feature of permitting replacement of individual panels to provide greater product life and cost savings.

The door opening is framed by two rigid doorposts, a sill, and a rigid header. The flexible door is semi-permanently attached to the roof with the same type of edge connection as those that attach the side panels to the roof. The attachment is semi-permanent in that while the panels are not releasable while the container is in service, they can be disengaged when necessary to replace a single panel. The door panel is latched to the two vertical doorposts and the door sill through a unique locking mechanism when the door is closed.

During an explosion, the interconnected blast resistant panels will expand together much like an air bag in a controlled fashion, largely independent of the rigid frame structure. The blast energy is dissipated largely through interlayer de-lamination and tensile straining of the blast resistant panels. Since the container fully envelops and internalizes the blast effects, e.g. shock, fragment and gas pressure, the momentum of the container towards any random direction is relatively small. In other words, the tendency of the container to launch itself towards a certain favored direction during the explosion is minimal. Therefore, the impact on the surrounding aircraft structure by the container is minimized.

According to a presently preferred aspect, at each corner of the explosion resistant cargo container there is a second edge capturing rail segment on a second side of the container oriented in an approximate position of a first edge capturing rail segment on a first side of the container rotated by 180 degrees.

According to another presently preferred aspect, the explosion resistant cargo container includes a spacer member between adjacent panels configured such that the fastener extends through two of the panels, the edge capturing rail segment, and the spacer member. The spacer member may be an extension of a base rail of the frame assembly. Or, the spacer member may be an extension of a roof beam of the frame assembly.

According to another presently preferred aspect, the edges of the panels of the container with which the flexible door panel mates include an outboard doorpost, an inboard doorpost, and a bottom door sill. The explosion resistant cargo container may also include a latch configured to secure and release the flexible door panel, the latch disposed along an edge of each of the outboard doorpost, the inboard doorpost, and the bottom door sill. Each of the two side edges and the bottom edge of the flexible door panel may have a locking rail segment extending along a length thereof beyond the edge capturing rail segment and receivable by a corresponding hook within the latch of the outboard doorpost, the inboard doorpost, or the bottom door sill, respectively. The explosion resistant cargo container may also include a detent bar on the latch, the detent bar configured to lock the locking rail segment of the two side edges and the bottom edge of the flexible door panel within the corresponding hook of the latch on the outboard doorpost, the inboard doorpost, and the bottom door sill, respectively. The explosion resistant cargo container according to any of the aspects outlined above may include a handle on the latch on an outside of the container.

According to some aspects, the detent bar may have a plurality of protruding teeth configured to be received in corresponding slots of the outboard doorpost, the inboard doorpost, or the bottom door sill of the frame assembly. Each detent bar may have a plurality of holes, including a first hole configured for mounting a handle lever and a second hole configured for receiving a guide pin. The second hole on the detent bar may be configured as an elongated slot for receiving a guide pin that mounts the detent bar to the frame assembly, and the elongated slot may be longer than a diameter of the guide pin along at least one direction to permit movement of the guide pin within the slot along that at least one direction.

In another presently preferred aspect, an explosion resistant cargo container suitable for aircraft or seagoing vessels for containing the effects of a bomb explosion within the cargo container, includes a frame assembly; a plurality of panels mounted to the frame assembly, the plurality of panels including a top explosion resistant panel, a bottom explosion resistant panel, a plurality of explosion resistant side panels, and an explosion resistant flexible door panel having two side edges and a bottom edge, the two side edges of the flexible door panel mating with corresponding edges of side panels of the container including an outboard doorpost and an inboard doorpost, and the bottom edge of the flexible door panel mating with a corresponding bottom door sill, the side panels and flexible door panel each being formed of a plurality of explosion resistant sheets, each sheet of said plurality being formed of an explosion resistant, flexible, high tensile strength material, the plurality of explosion resistant sheets having edges that are wrapped around and secured to an edge rod; an edge capturing rail segment wrapped around each plurality of explosion resistant sheets over each edge rod, securing adjacent edges of the panels together; and a plurality of fasteners, each fastener extending through two or more panels and an edge capturing rail segment.

Other features and advantages of the present invention will become more apparent from the following detailed description of the preferred embodiments in conjunction with the accompanying drawing, which illustrates the construction of a lightweight laminated panel material for construction of cargo containers, according to the invention.

DETAILED DESCRIPTION OF THE PREFERRED EMBODIMENTS

Figure 4:
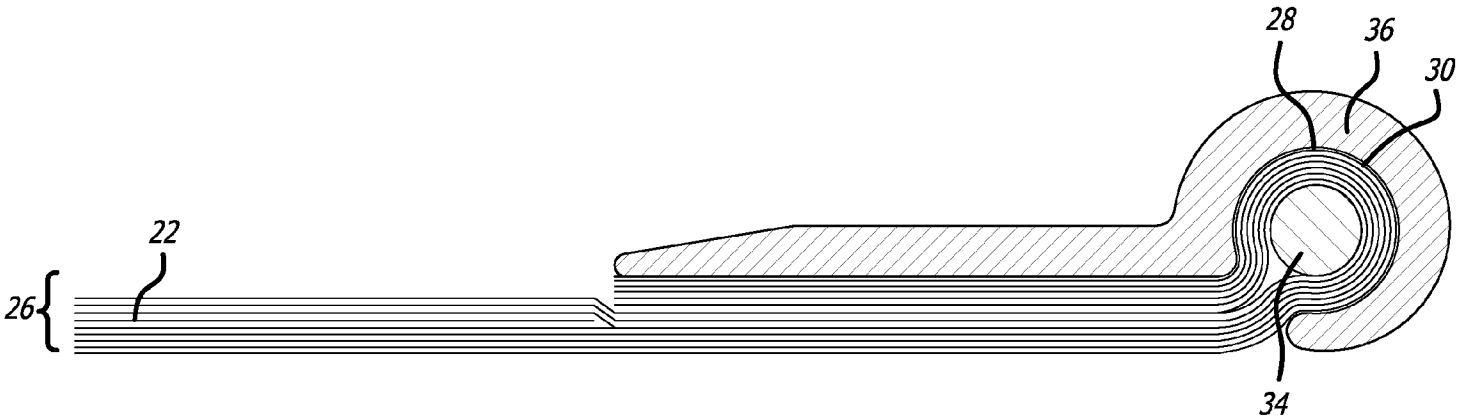
FIG. 4 is a side view of an edge of a multi-ply blast resistant panel wrapped around an edge rod and secured by an edge capturing rail.

Referring to the drawings, which are provided by way of example, and not by way of limitation, an explosion resistant cargo container 2 suitable for aircraft or seagoing vessels for containing the effects of a bomb explosion within the cargo container, includes a frame assembly 4 and a plurality of panels 6 mounted to the frame assembly. The plurality of panels 6 include a top explosion resistant panel 8, a bottom explosion resistant panel 10, a plurality of explosion resistant side panels 12, and an explosion resistant flexible door panel 14 having two side edges 16, 18 and a bottom edge 20. The side panels 12 and flexible door panel 14 are each formed of two or more explosion resistant sheets, each sheet 22 being formed of an explosion resistant, flexible, high tensile strength material. The explosion resistant sheets 26 have edges 28 that are each wrapped around 30 and secured to an edge rod 34, as shown in FIG. 4. Also provided are a plurality of edge capturing rail segments 36 wrapped around the explosion resistant sheets 26 over each edge rod 34, thereby securing adjacent edges 42 of the panels together and a plurality of fasteners 44, each fastener extending through two or more panels and an edge capturing rail segment 36.

At each corner 46 of the container 2, a second 48 edge capturing rail segment on a second side 50 of the container may be oriented in an approximate position of a first 52 edge capturing rail segment on a first side 54 of the container but rotated by 180 degrees, as shown in FIG. 6-9. A spacer member 56 between adjacent 42 side panels may also be provided as part of the panel interconnection mechanism in which a fastener 44 extends through two of the adjacent 42 panels, the edge capturing rail segments 48, 52 and the spacer member.

Figure 6:
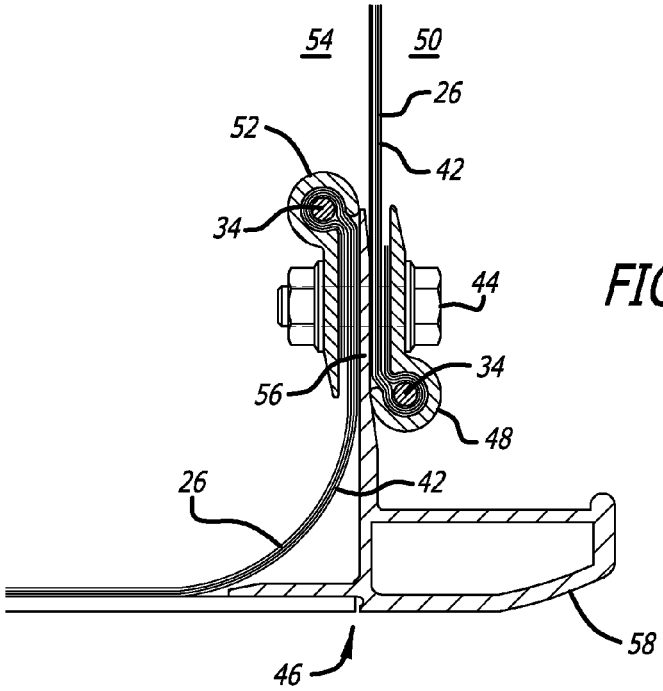
FIG. 6 is a cross-sectional view looking horizontally along lines 6-6' of FIG. 1 at the container corner formed by the base rail, inboard panel, and rear panel.
Figure 7:
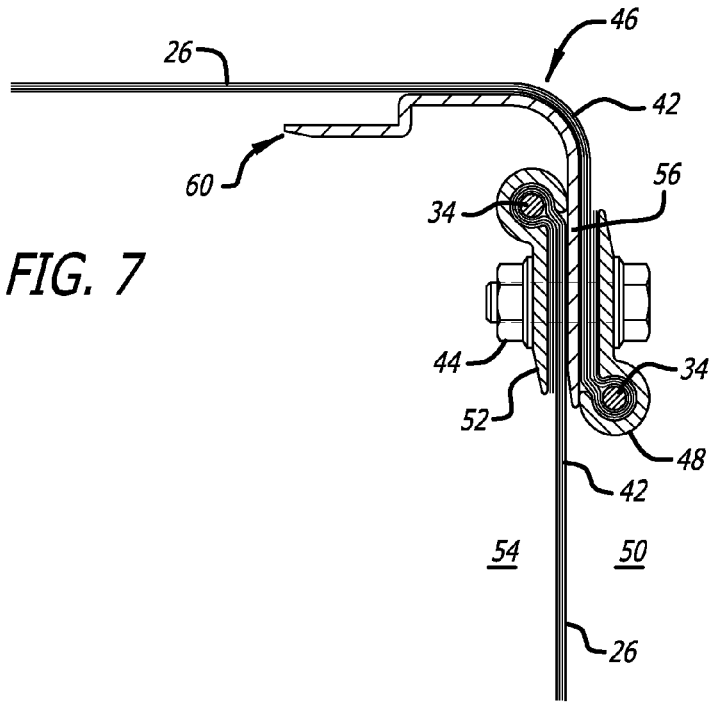
FIG. 7 is a cross-sectional view looking horizontally along lines 7-7' of FIG. 1 at the container corner formed by the roof panel, inboard panel, and rear panel.
Figure 8:
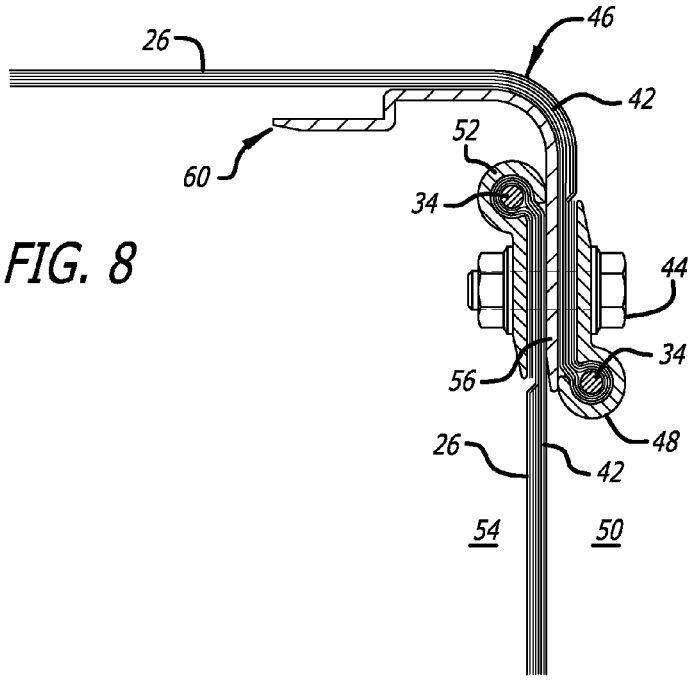
FIG. 8 is a cross-sectional view looking horizontally along lines 8-8' of FIG. 2 at the container corner formed by the roof panel, outboard panel, and front shear panel.
Figure 9:
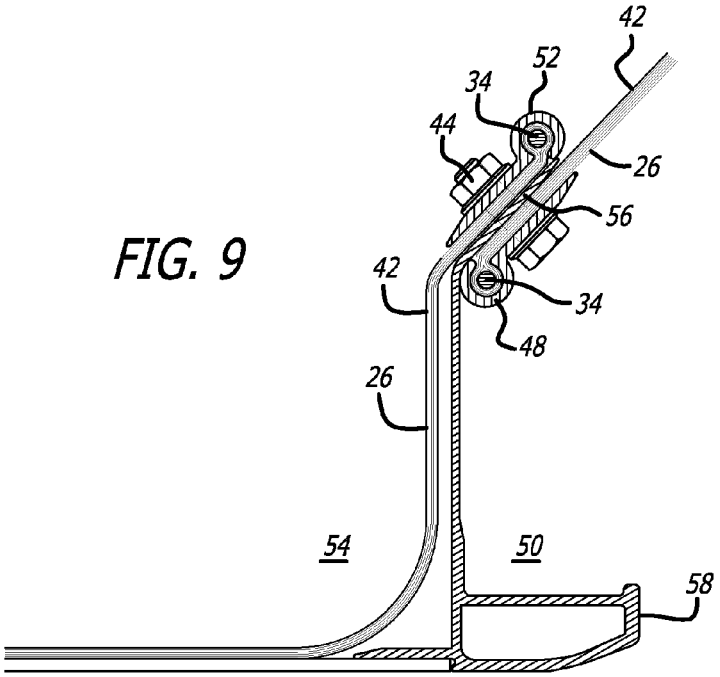
FIG. 9 is a cross-sectional view looking horizontally along lines 9-9' of FIG. 2 at the container corner formed by the base rail, outboard panel, and front shear panel.

In regard to FIGS. 6 and 9, the frame assembly 4 of the explosion resistant cargo container 2 may also include a base rail 58 and the spacer member 56 incorporated in the mating mechanism of adjacent 42 panels may be an extension of this base rail. Similarly, for corners 46 or edges of the container 2 where adjacent 42 panels meet at the top of the container, the spacer member 56 may be an extension of a roof beam 60.

Figure 3:
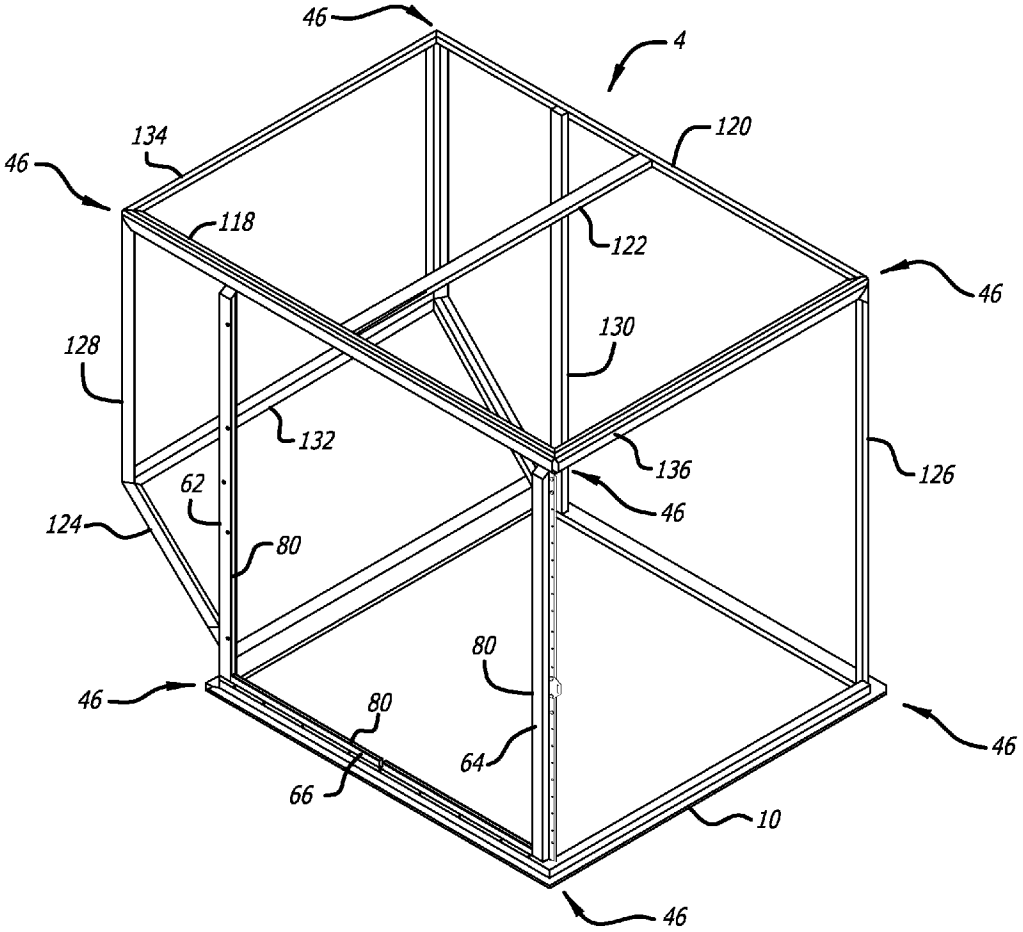
FIG. 3 is a front perspective view from overhead of a skeletal structure of the container of FIG. 1.

With regard to the frame assembly 4 or skeletal structure for the container as shown in FIG. 3, the edges of the panels of the container with which the flexible door panel 14 mates include an outboard doorpost 62, an inboard doorpost 64, and a bottom door sill 66.

Figure 5:
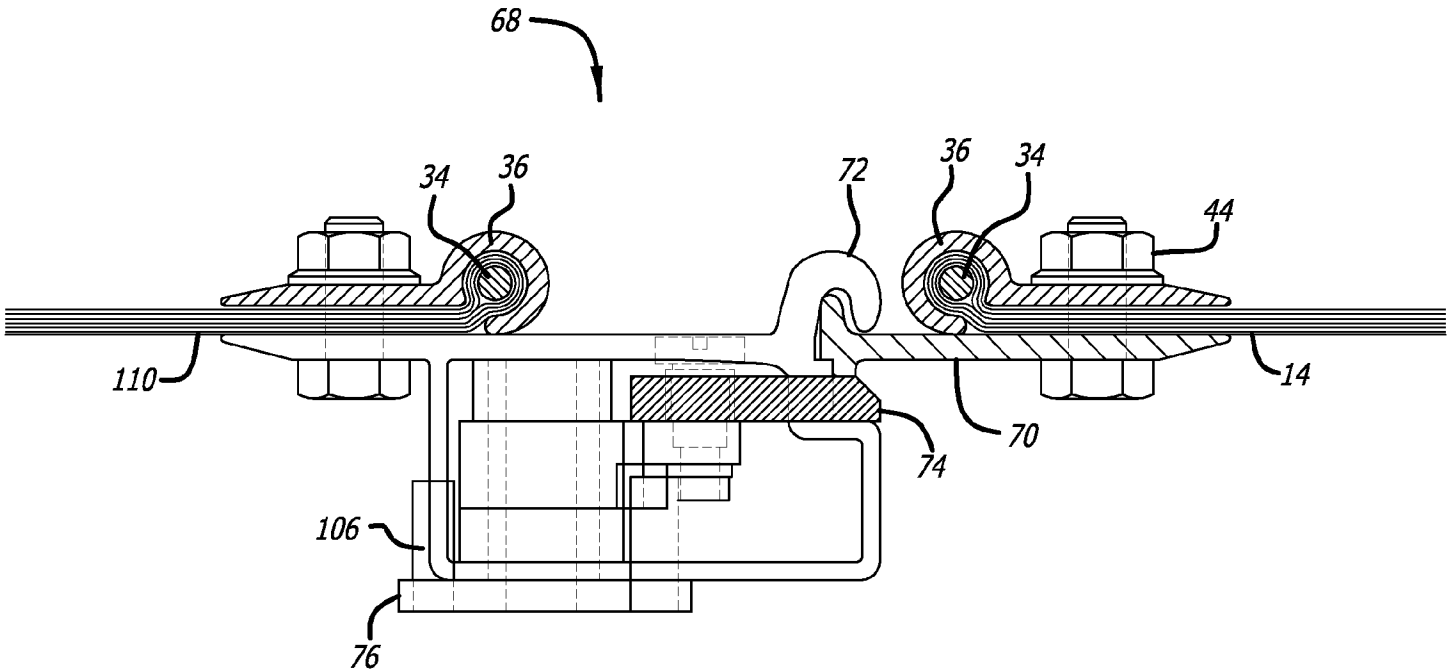
FIG. 5 is a cross-sectional view looking downward along lines 5-5' of FIG. 1 illustrating the door latching mechanism in accordance with principles of the present invention.

The container 2 also includes a latch 68, as shown in FIG. 5, configured to secure and release the flexible door panel 14 from its closed position in which it is secured to a doorpost 62, 64 or door sill 66 along each of the panels 110, 114, 10 with which the free edges 16, 18, 20 of the flexible door panel 14 meet. Latch 68 is disposed along an edge of each of the outboard doorpost 62, the inboard doorpost 64, and the bottom door sill 66 as shown from a distance in FIG. 1.

Figure 10:
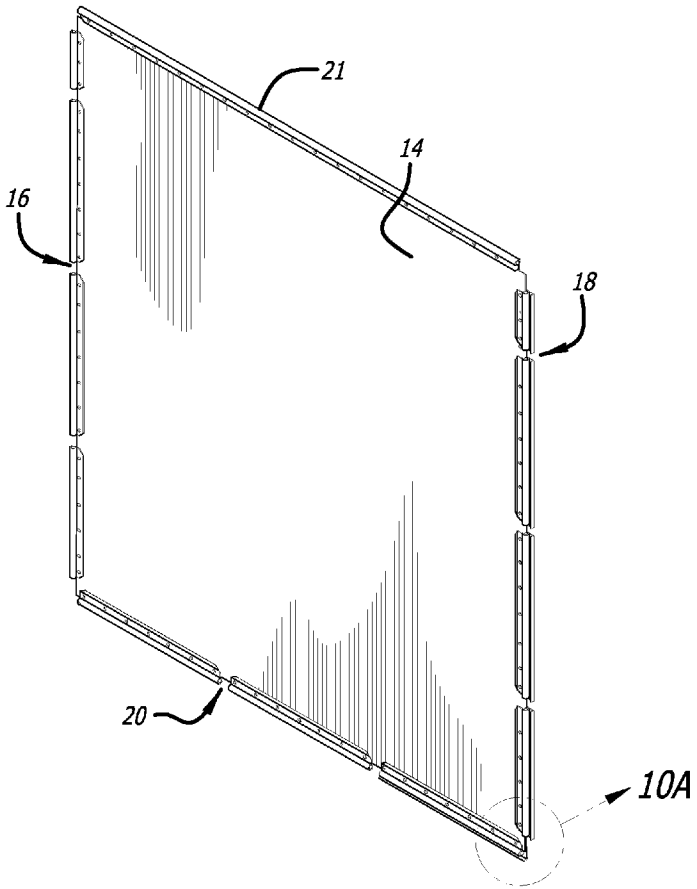
FIG. 10 is a front perspective view of an isolated flexible door panel for the container, including an inset blow-up view.
Figure 10A:
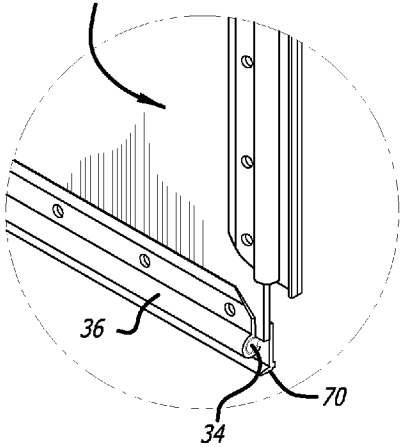

With regard to FIGS. 5 and 10, each of the two side edges 16, 18 and the bottom edge 20 of the flexible door panel 14 include a locking rail segment 70 extending along a length thereof beyond the edge capturing rail segment 36 and receivable by a corresponding hook 72 within the latch 68 of the outboard doorpost 62, the inboard doorpost 64, or the bottom door sill 66, respectively.

The latch 68 may include a detent bar 74 as illustrated in FIGS. 5 and 11-15. Detent bar 74 is configured to lock the locking rail segment 70 of the two side edges 16, 18 and the bottom edge 20 of the flexible door panel 14 within the corresponding hook 72 of the latch 68 on the outboard doorpost 62, the inboard doorpost 64, and the bottom door sill 66, respectively. This locking may be accomplished, in part, through a plurality of protruding teeth 78 or other extensions of the detent bar 74 configured to be received in corresponding slots 80 of the outboard doorpost 62, the inboard doorpost 64, or the bottom door sill 66 of the frame assembly 4.

As shown in FIG. 11-15, each detent bar 74 may include a plurality of holes 82, including a first hole 84 configured for mounting a handle 76 or handle lever 96 and a second group of holes 86 configured as elongated slots 90 for receiving a guide pin 88. The elongated slot 90 is longer than a diameter 92 of the guide pin 88 along at least one direction to permit movement of the guide pin within the slot along the at least one direction. The ability of the guide pins 88 to move within the slots 90 along the elongated axis is advantageous in that it permits the release of some of the internal pressure without compromising the structural integrity of the container the containment function.

Outside of the container 2, a handle 76 on the latch 68 can be manipulated to release the secured door panel 14 along each of the three free edges 16, 18, and 20. For example, the handle 76 may be manipulated by rotating it as suggested in FIGS. 12, 13 and 15.

Figure 1:
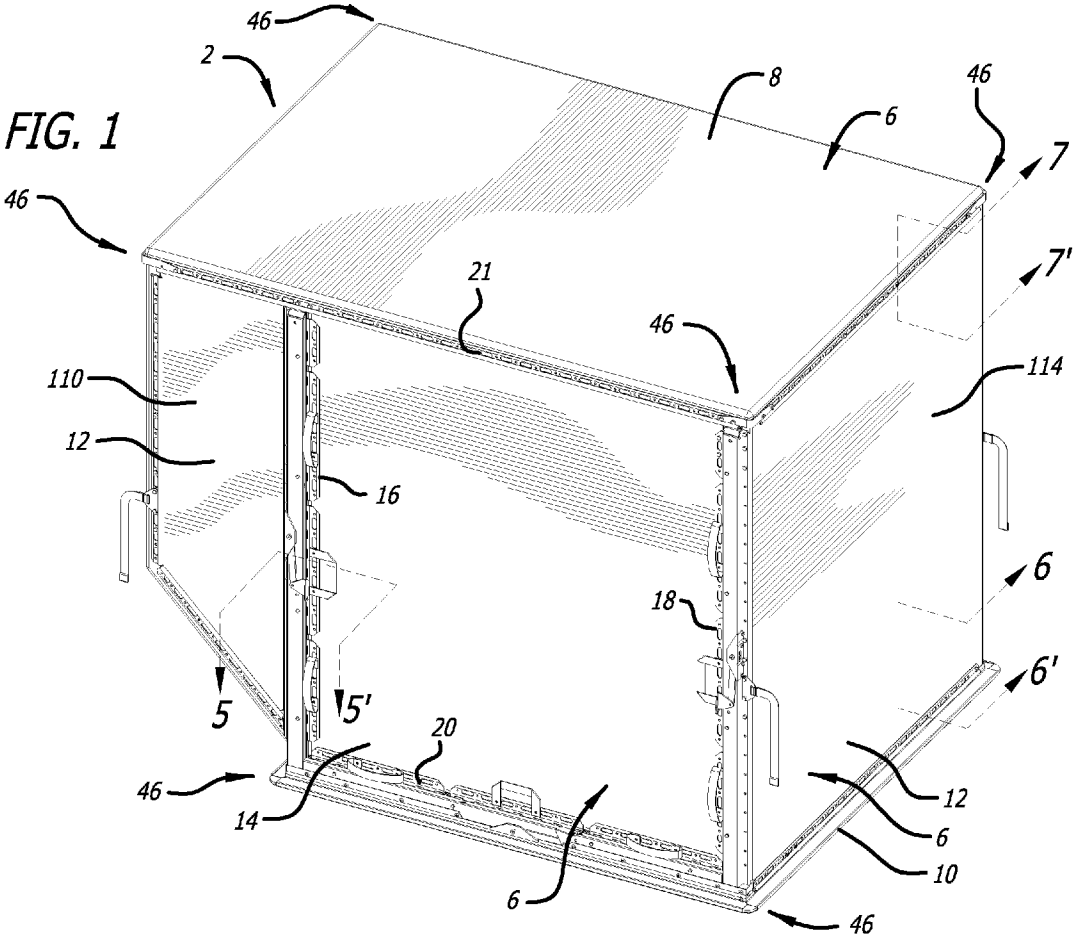
FIG. 1 is a front perspective view from overhead of a blast resistant aircraft cargo container according to principles of the invention.
Figure 2:
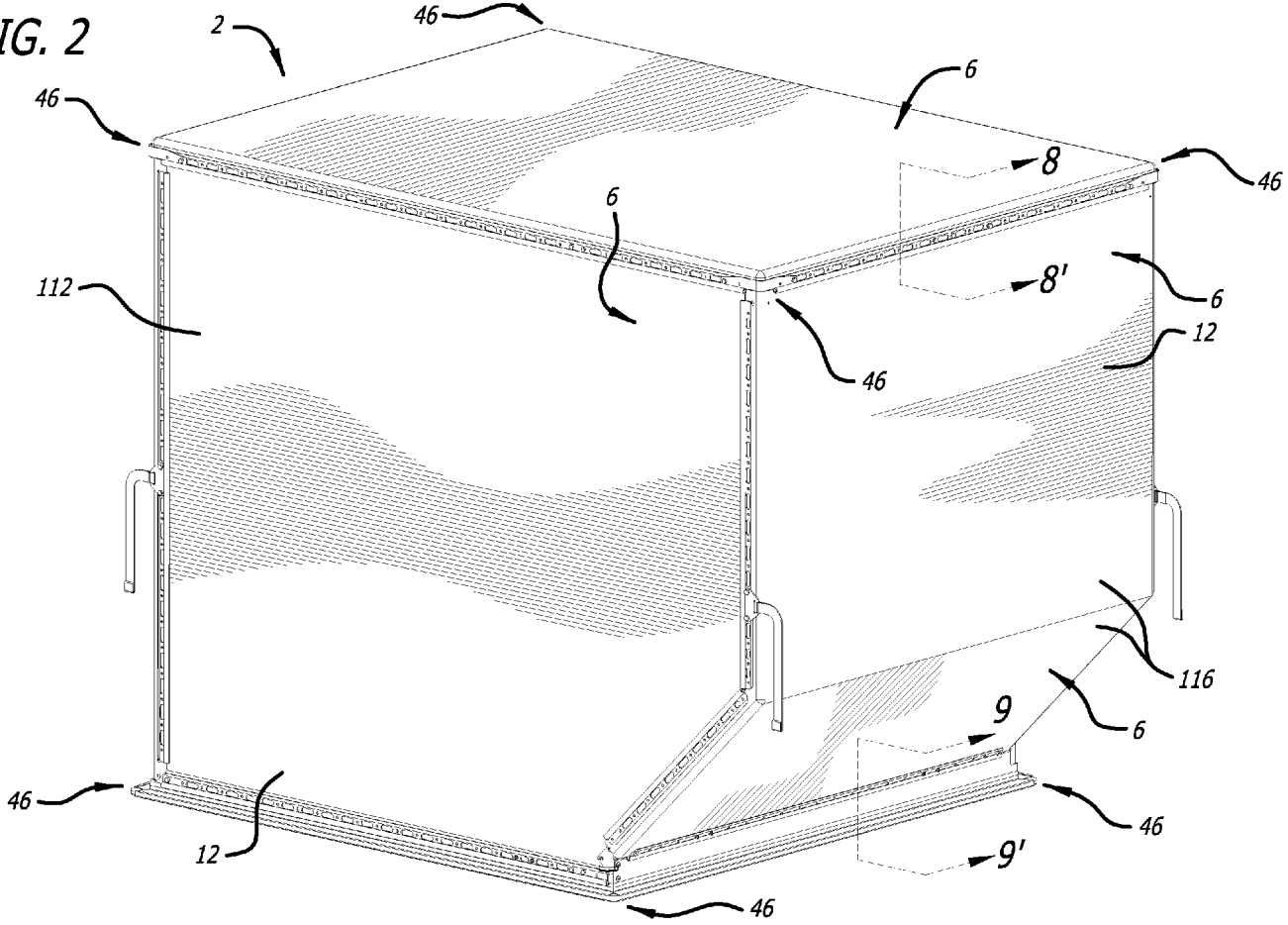
FIG. 2 is a rear perspective view from overhead of the blast resistant aircraft cargo container of FIG. 1.

As shown in FIG. 1 (front view) and FIG. 2 (rear view) the heat and explosion resistant container in accordance with an embodiment of the present invention may be irregularly shaped. For example, the container may include a cubic section joined with a trapezoidal section. The container is formed of several panels joined together and supported on a base pallet 10. There is a roof panel 8, flexible door panel 14, and several explosion resistant side panels 12, specifically inboard panel 114, outboard panel 116, rear panel 112, and front shear panel 110.

FIG. 3 illustrates additional structural detail of the supporting frame. Notice the intermediate posts or beams including roof stiffener 122 approximately bisecting the roof panel 8 and being parallel to and approximately halfway between outboard roof beam 134 and inboard roof beam 136. Additionally, there is hip stiffener 132 forming an edge of the trapezoidal section. Other support members include header 118 and rear roof beam 120 along the top and back stiffener 130, corner post 126, outboard corner post 128, and slope strut 124 at the sides.

The two doorposts 62, 64 and the door sill 66 (shown in FIG. 3) each contain a hook 72, as shown in FIG. 5, to receive the locking rail segments 70 installed along the three free door edges (bottom edge 20, left side edge 16, and right side edge 18 of flexible door panel 14). A detent bar 74 in each of the doorposts 62, 64 and the door sill 66 is extended by a unique latching mechanism as shown and as also partially illustrated in FIG. 11-15, to trap the locking rail segments 70 along the door edges in the hooks 72 of the doorposts 62, 64 and door sill 66.

Each blast resistant panel 6 is made of multiple layers or sheets 26, each layer or sheet 22 formed of a high strength woven material and bonded together with adhesive films. The edge of the panel wraps around a cylindrical rod 34 and is bonded to the rod as well as itself with adhesive, forming a folded edge much like a corded hem, as shown in FIG. 4-9. The cylindrical rod 34 provides a smooth bend on the laminates and prevents the fibers from fracturing when loaded. Each rod embedded panel edge is then captured in the receiving groove on a rigid edge capturing rail segment 36, as shown in FIG. 4. Similarly, reference numerals 48 and 52 are used to designate adjacent edge capturing rail segments as shown in FIG. 6-9.

The joining edges 42 of two neighboring panels overlap one another with both of the first and second edge capturing rails 52, 48 nestling against the panels opposite to one another as shown in FIG. 6-9. In this manner, a second edge capturing rail segment 48 on a second side 50 of the container 2 is in approximately the same position as a first edge capturing rail segment 52 on a first side 54 of the container. There may also be a spacer 56 placed between the joining panel edges 42, which may be an extension of the base rail 58 or a roof beam 60. Fasteners 44 are installed along the joined edge through the edge capturing rails 36/48/52, the panels 26, and any spacers 56.

This unique panel connection design is particularly advantageous for resisting blast load impulses owing to the resist-slip-resist feature. When the tensile load in the panel reaches a certain magnitude which can overcome the holding power of the edge capturing rail 36, the rod embedded edge of the panel will slip out of the groove in the rail, dissipating blast energy along the way. As the joining panels continue to stretch at their adjacent edges 42, the connection takes up the load by wedging the rod embedded panel edge between the two edge capturing rails 48, 52 which are held firmly together by the fasteners 44 (see FIG. 6-9).

The flexible door panel 14, as seen in FIGS. 1, 5 and especially in FIG. 10, has three free edges: the left edge 16, right edge 18 and bottom edge 20. Each free edge of the door panel consists of multiple rod embedded edge capturing segments 36 having an inside edge capturing a locking rail segment 70 having a cross-sectional shape resembling the shape of a boot, as shown in FIGS. 5 and 10. The locking rail segments 70 are received by a hook 72 in the doorpost 62, 64 or door sill 66 of the frame assembly 4, as seen in FIG. 3.

Figure 11:
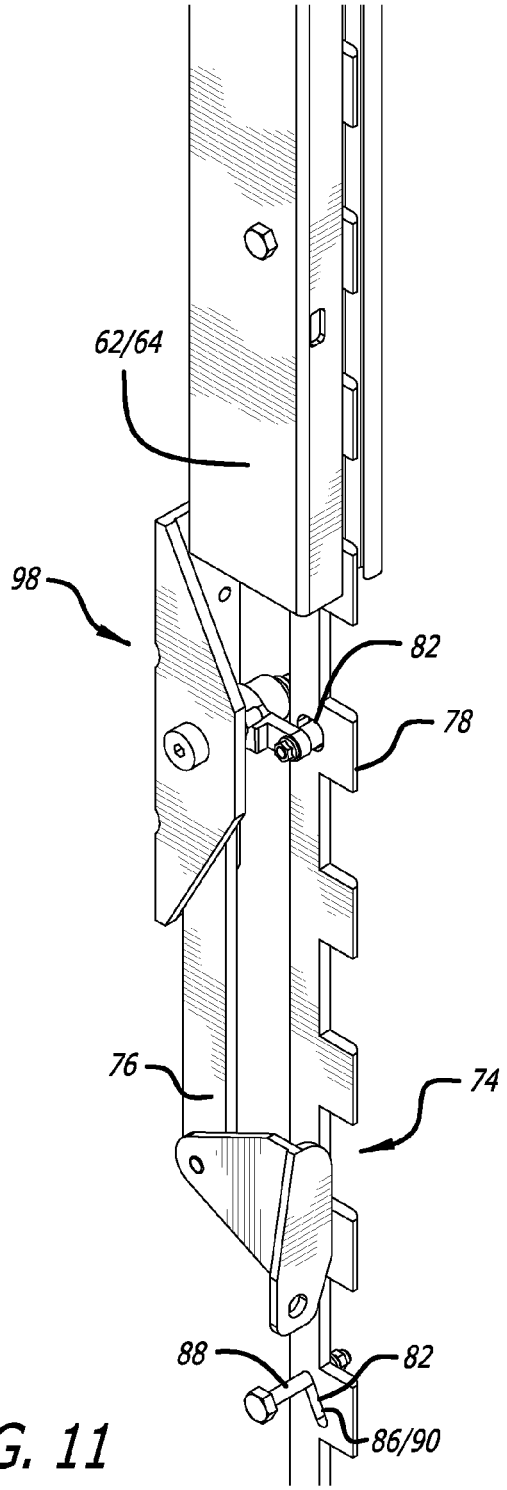
FIG. 11 is a first perspective of an isolated door latching mechanism according to principles of the invention.
Figure 12:
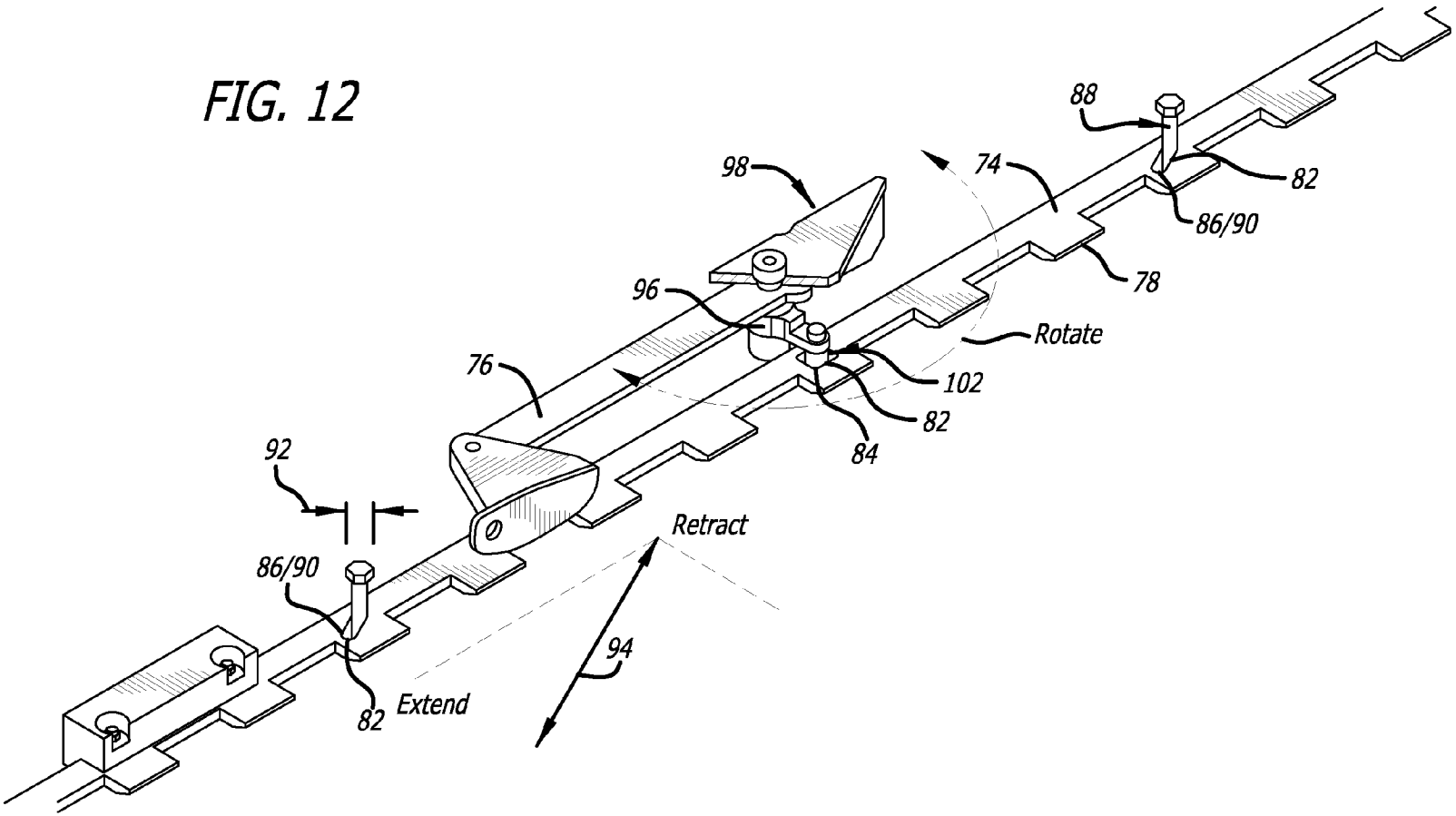
FIG. 12 is a second perspective view of the door latching mechanism according to principles of the invention.
Figure 13:
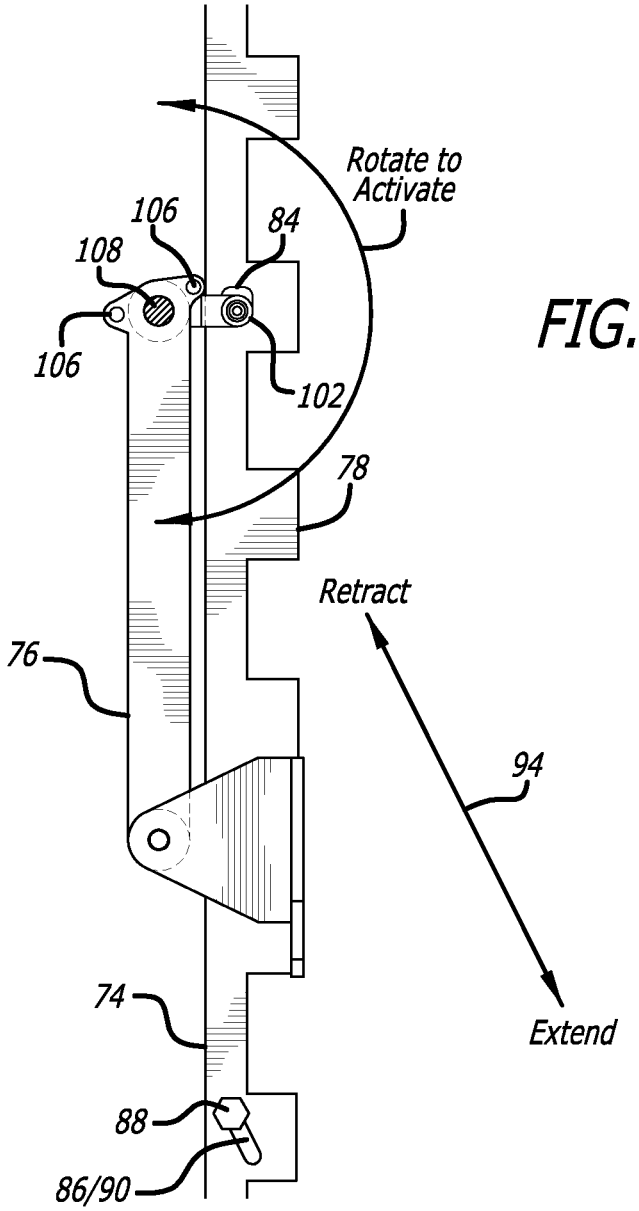
FIG. 13 is a side view of the door latching mechanism according to principles of the invention.
Figure 14:
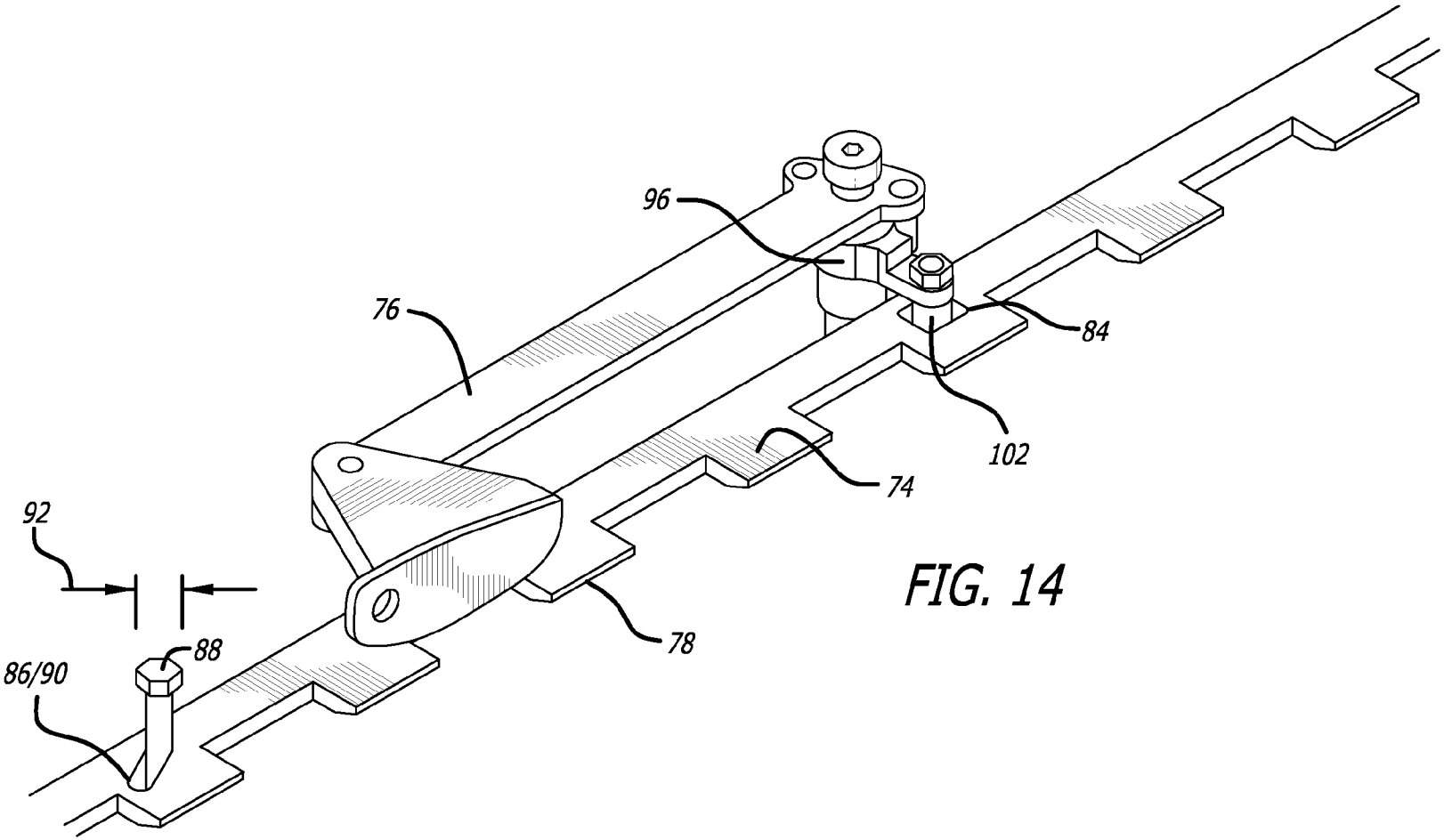
FIG. 14 is a third perspective view of the door latching mechanism according to principles of the invention.

Referring to FIG. 11-15, the detent bar 74 installed inside the doorposts 62, 64 or the door sill 66 contains a number of holes 82, including a first group of holes 86 configured as slanted slots 90 for receiving an equal number of guide pins 88 passing through the holes 86. The guide pins 88 fit loosely within the holes 82, having a diameter that is shorter than the long axis of the elongated slot 90. Accordingly, the guide pines 88 are configured to move back and forth 94 within the slots 90 and are anchored on the doorposts 62, 64 or the door sill 66 to limit the bar 74 such that it only moves back and forth along the slot direction, as shown in FIGS. 12 and 13.

With regard to FIGS. 5 and 11-17, the latching mechanism includes a handle 76 and a lever 96 having a common pivot point 108, but both are able to rotate independently of each other through some portion of the rotation. There are two activation pins 106 on the handle 76 which come in contact with the lever 96 when the handle reaches a certain angle, thereby forcing the lever to rotate with the handle. As the handle and the lever continue to rotate, the cam roller 102 attached to the lever 96 pushes the detent bar 74 and forces it to slide against the guide pins 88. When the detent bar 74 is fully extended, the locking rail segments 70 along the door edge are fully trapped, as shown in FIG. 5. The door panel 14 is fully locked when all three detent bars (the left, right and bottom) are engaged.

Figure 16:
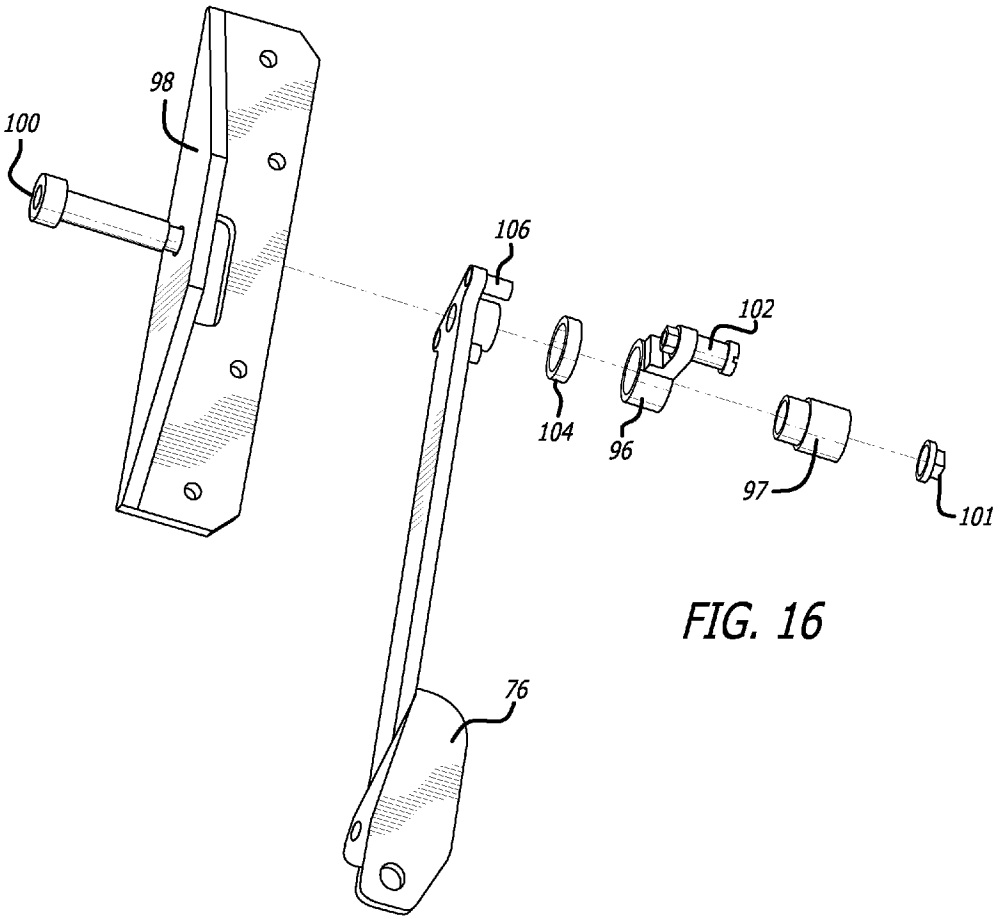
FIG. 16 is a first exploded perspective view of the handle and pivot about which the handle rotates to open and close the flexible door panel according to principles of the invention.
Figure 17:
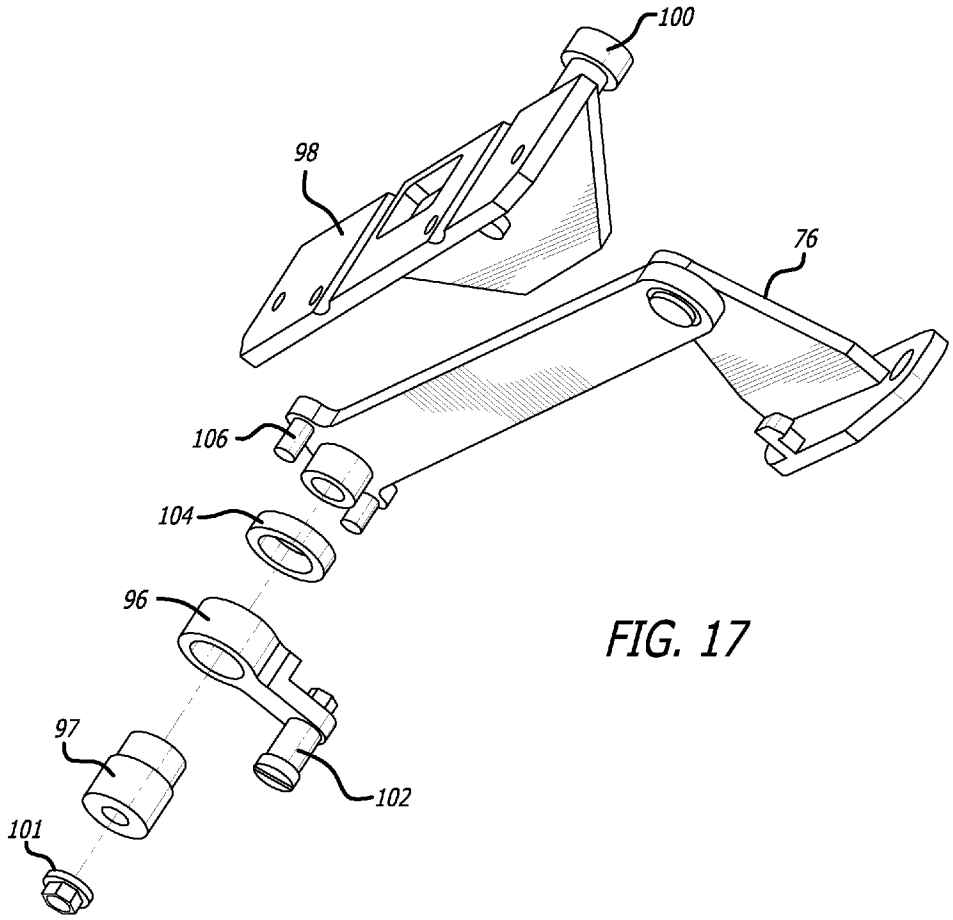
FIG. 17 is a second exploded perspective view of the handle and pivot about which the handle rotates to open and close the flexible door panel according to principles of the invention.

The flexible door panel 14 shown in FIG. 10 includes an upper edge 21 attached permanently to the roof panel 8 and three other edges: bottom edge 20, left edge 16, and right edge 18. Each of these other edges can be releasably secured to a side doorpost 62, 64 or bottom door sill 66 of the frame assembly 4 as shown in FIG. 3. The details of the latching mechanism through which the flexible door panel 14 is removably or releasably secured to the frame assembly 4 are shown in FIGS. 5 and 11-15. The details of the handle 76 which open and closes the door are shown in FIG. 16-17.

As shown in FIG. 5 this latching mechanism involves front shear panel 110 (or another panel such as inboard panel 114 for the right side door edge 18 or bottom panel/base pallet 10 for the bottom free door edge 20) with a doorpost, here outboard doorpost 62, including a latch 68 mounted thereon. The latch 68 includes a handle 76 and is operated via an activation pin 106. A fastener 44 at the edge of the front shear panel 110 holds the latch 68 in position in a sandwich together with the panel 110, edge rod 34, and edge capturing rail 36. The doorpost latch 68 includes a hook 72, groove or channel configured for receiving the locking rail segment 70 extending from the flexible door panel 14. Detent bar 74 on the latch 68 completes the locking arrangement. If the handle 76 is turned, this will eventually cause the cam roller 102 to move the detent bar 74 so that it releases the locking rail segment 70 of the door panel 14, thereby releasing the door at least along that edge.

FIG. 5-9 show how two panels come together along an edge of the container. FIG. 5 shows the door panel as discussed above. FIGS. 6 and 9 include two adjacent panel edges 42 formed along the bottom and supported by base rail 58 while FIGS. 7 and 8 include two adjacent panel edges 42 formed along the top of the container and including roof beam 60. Extensions of both the base rail 58 and roof beam 60 may reach as far as the sandwiched joint where the fastener 44 holds the two edges together. The edges may be inverted symmetrical images of each other in which one edge, including panel 26 wrapped around rod 34 and secured by edge capturing rail 36 resembles the edge of the adjoining panel rotated by 180 degrees.

FIGS. 5 and 11-15 show the details of the latching mechanism. FIG. 11 shows how detent bar 74 is disposed along the doorpost or door sill, which refers to a doorpost or door sill generally and could be any one of doorposts 62 or 64 or door sill 66 as shown in FIG. 3. Given the holes 86 configured as slanted slots 90 through which the detent bar 74 is mounted to the frame with guide pins 88, it is able to move 94 about the pins extending and retracting as the latch is secured and undone.

Figure 15:
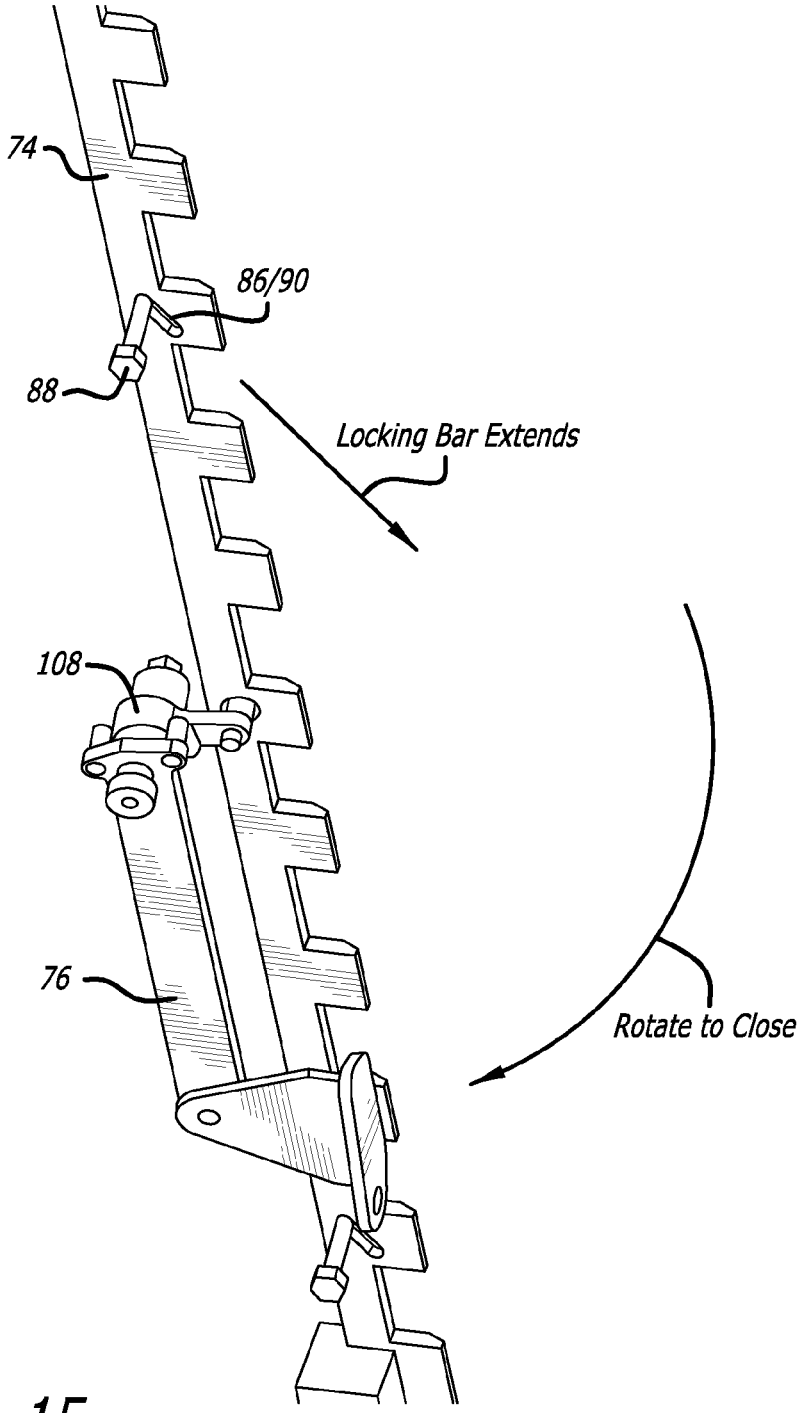
FIG. 15 is a fourth perspective view of the door latching mechanism according to principles of the invention.

In regard to FIGS. 12-13 and 15, the handle 76 is rotated about the common handle and lever pivot point 108 to open and close the flexible door panel 14. As the handle 76 is rotated through its full range it changes position from being on one side of the cam roller 102 and closer to a first slanted slot to being on the other side of the cam roller and closer to a second slanted slot. A lever guard 98 provides some protection around the lever 96. As the handle 76 rotates, through the common connection of the cam roller 102 to the same lever 96 to which the handle is connected, the cam roller is also actuated to extend and retract the detent bar 74 about the guide pins 88 securing it to the frame 4 as facilitated by the oversized slanted slots 90.

As shown in FIG. 13 the handle 76 and the lever 96 share a common pivot point 108. The handle 76 is further retained about the lever 96 with activation pins 106 which facilitate the latching mechanism as also illustrated in FIG. 5.

FIGS. 16 and 17 provide greater detail of the lever 96 which connects handle 76 to cam roller 102, showing the lever guard pin 100, lever guard 98, washer 104, bottom lever part 97, and lever securing nut 101.

Suitable blast resistant panel materials and constructions include but are not limited to woven materials made from aramid, UHMW polyethylene, liquid crystal polymer, polyvinyl alcohol, polyhydroquinone-diimidazopyridine (M5), poly(p-phenylene-2,6-benzobisoxazole) (PBO), carbon, glass, polypropylene, or polyamide fibers. Suitable adhesives include film adhesives made from polyolefin, urethane, ionomer, or ethyl vinyl acetate thermoplastics and film adhesives made from epoxy, phenolic, or vinyl ester thermosets. One or more ply or layer of the woven materials and adhesives may be used for each panel. Suitable materials for the embedded edge rod include but are not limited to plastics or composites, or metals such as aluminum or magnesium. Suitable materials for the edge capturing rail include but are not limited to extruded or roll-formed aluminum or magnesium rails. Suitable materials for the frame structure include but are not limited to extruded or roll-formed aluminum or magnesium rails and composite protrusions.

The blast resistant container constructed in accordance with the principles of the present invention has successfully passed the cargo blast test in accordance with the requirements set forth in "Classified Addendum to TSO-C (HC-R) Draft Appendix A" issued by the Department of Homeland Security.

One specific example of the benefits provided by the blast resistant cargo/baggage containers in accordance with the present invention is the ability to more safely transport batteries and contain any explosion thereof. For example, especially the larger batteries used for personal laptop computers and clean energy vehicles increase the risk of an explosion, burning, or leakage during transit. Various embodiments of the present invention permit contemporary batteries to be transported safely while minimizing the risk of any incidents impacting other goods in transit being carried nearby the batteries.

Another specific example of the benefits provided by blast resistant cargo/baggage containers in accordance with the present invention is the ability to guard against terrorism in the form of explosives concealed in luggage that slip through airport security to arrive onboard in the stowage compartment. Civil aviation has been one of the prime targets of terrorist attack. The blast resistant cargo/baggage container has been identified as an effective means of improving the survivability of commercial aircraft in a blast event caused by an explosive device hidden in baggage or cargo.

It will be apparent from the foregoing that while particular forms of the invention have been illustrated and described, various modifications can be made without departing from the spirit and scope of the invention. Accordingly, it is not intended that the invention be limited, except as by the appended claims.

We claim:

1. An explosion resistant cargo container suitable for aircraft or seagoing vessels for containing the effects of a bomb explosion within the cargo container, comprising:

a frame assembly;

a plurality of panels mounted to said frame assembly, said plurality of panels including a top explosion resistant panel, a bottom explosion resistant panel, a plurality of explosion resistant side panels, and an explosion resistant flexible door panel having two side edges and a bottom edge, said side panels and flexible door panel each being formed of a plurality of explosion resistant sheets, each sheet of said plurality being formed of an explosion resistant, flexible, high tensile strength material, said plurality of explosion resistant sheets having edges that are wrapped around and secured to an edge rod;

an edge capturing rail segment wrapped around each said plurality of explosion resistant sheets over each edge rod, securing adjacent edges of said panels together;

a plurality of fasteners, each fastener extending through two or more panels and an edge capturing rail segment; and said frame assembly including a roof beam, said roof beam including a spacer member formed as an extension of said roof beam, said spacer member being disposed between adjacent panels, and wherein each fastener extends through two of said panels, the edge capturing rail segment, and the spacer member.

2. The explosion resistant cargo container of claim 1, wherein at each corner a second edge capturing rail segment on a second side of the container is oriented in an approximate position of a first edge capturing rail segment on a first side of the container rotated by 180 degrees.

3. The explosion resistant cargo container of claim 1, wherein edges of the panels of the container with which the flexible door panel mates include an outboard doorpost, an inboard doorpost, and a bottom door sill.

4. The explosion resistant cargo container of claim 3, further comprising a latch configured to secure and release the flexible door panel, the latch disposed along an edge of each of the outboard doorpost, the inboard doorpost, and the bottom door sill.

5. The explosion resistant cargo container of claim 4, wherein each of the two side edges and the bottom edge of the flexible door panel has a locking rail segment extending along a length thereof beyond the edge capturing rail segment and receivable by a corresponding hook within the latch of the outboard doorpost, the inboard doorpost, or the bottom door sill, respectively.

6. The explosion resistant cargo container of claim 4, further comprising a handle on the latch on an outside of the container.

7. An explosion resistant cargo container suitable for aircraft or seagoing vessels for containing the effects of a bomb explosion within the cargo container, comprising:

a frame assembly;

a plurality of panels mounted to said frame assembly, said plurality of panels including a top explosion resistant panel, a bottom explosion resistant panel, a plurality of explosion resistant side panels, and an explosion resistant flexible door panel having two side edges and a bottom edge, the plurality of panels mounted to said frame assembly having edges with which the flexible door panel mates, said edges with which the flexible door panel mates including an outboard doorpost, an inboard doorpost, and a bottom door sill, said side panels and flexible door panel each being formed of a plurality of explosion resistant sheets, each sheet of said plurality being formed of an explosion resistant, flexible, high tensile strength material, and said plurality of explosion resistant sheets having edges that are wrapped around and secured to an edge rod;

an edge capturing rail segment wrapped around each said plurality of explosion resistant sheets over each edge rod, securing adjacent edges of said panels together;

a plurality of fasteners, each fastener extending through two or more panels and an edge capturing rail segment;

a latch configured to secure and release the flexible door panel, the latch disposed along an edge of each of the outboard doorpost, the inboard doorpost, and the bottom door sill;

each of the two side edges and the bottom edge of the flexible door panel having a locking rail segment extending along a length thereof beyond the edge capturing rail segment and receivable by a corresponding hook within the latch of the outboard doorpost, the inboard doorpost, or the bottom door sill, respectively; and a detent bar on the latch, the detent bar configured to lock the locking rail segment of the two side edges and the bottom edge of the flexible door panel within the corresponding hook of the latch on the outboard doorpost, the inboard doorpost, and the bottom door sill, respectively.

8. The explosion resistant cargo container of claim 7, the detent bar having a plurality of protruding teeth configured to be received in corresponding slots of the outboard doorpost, the inboard doorpost, or the bottom door sill of the frame assembly.

9. The explosion resistant cargo container of claim 7, wherein each detent bar further comprises a plurality of holes including a first hole configured for mounting a handle lever and a second hole configured for receiving a guide pin.

10. The explosion resistant cargo container of claim 9, wherein the second hole on the detent bar is configured as an elongated slot for receiving a guide pin that mounts the detent bar to the frame assembly, wherein the elongated slot is longer than a diameter of the guide pin along at least one direction to permit movement of the guide pin within the slot along said at least one direction.

11. An explosion resistant cargo container suitable for aircraft or seagoing vessels for containing the effects of a bomb explosion within the cargo container, comprising:

a frame assembly;

a plurality of panels mounted to said frame assembly, said plurality of panels including a top explosion resistant panel, a bottom explosion resistant panel, a plurality of explosion resistant side panels, and an explosion resistant flexible door panel having two side edges and a bottom edge, the two side edges of the flexible door panel mating with corresponding edges of the side panels of the container including an outboard doorpost and an inboard doorpost, and the bottom edge of the flexible door panel mating with a corresponding bottom door sill, said side panels and flexible door panel each being formed of a plurality of explosion resistant sheets, each sheet of said plurality being formed of an explosion resistant, flexible, high tensile strength material, said plurality of explosion resistant sheets having edges that are wrapped around and secured to an edge rod;

an edge capturing rail segment wrapped around each said plurality of explosion resistant sheets over each edge rod, securing adjacent edges of said panels together;

a plurality of fasteners, each fastener extending through two or more panels and an edge capturing rail segment;

a latch configured to secure and release the flexible door panel, the latch disposed along an edge of each of the outboard doorpost, the inboard doorpost, and the bottom door sill;

each of the two side edges and the bottom edge of the flexible door panel having a locking rail segment extending along a length thereof beyond the edge capturing rail segment and receivable by a corresponding hook within the latch of the outboard doorpost, the inboard doorpost, or the bottom door sill, respectively; and a detent bar on the latch, the detent bar configured to lock the locking rail segment of the two side edges and the bottom edge of the flexible door panel within the corresponding hook of the latch on the outboard doorpost, the inboard doorpost, and the bottom door sill, respectively.

12. The explosion resistant cargo container of claim 11, further comprising a handle on the latch on an outside of the container.

13. The explosion resistant cargo container of claim 11, the detent bar having a plurality of protruding teeth configured to be received in corresponding slots of the outboard doorpost, the inboard doorpost, or the bottom door sill of the frame assembly.

14. The explosion resistant cargo container of claim 11, wherein each detent bar further comprises a plurality of holes including a first hole configured for mounting a handle lever and a second hole configured for receiving a guide pin.

15. The explosion resistant cargo container of claim 14, wherein the second hole on the detent bar is configured as an elongated slot for receiving a guide pin that mounts the detent bar to the frame assembly, wherein the elongated slot is longer than a diameter of the guide pin along at least one direction to permit movement of the guide pin within the slot along said at least one direction.

* * * * *